US006201766B1

(12) United States Patent
Carlson et al.

(10) Patent No.: US 6,201,766 B1
(45) Date of Patent: Mar. 13, 2001

(54) MULTIPLE PRESSURE GRADIENT SENSOR

(76) Inventors: Thomas James Carlson, 17415 Cardinal Dr., Lake Oswego, OR (US) 97034; James Arlington Evans, 607 E. Askew, Tallulch, LA (US) 71282; John Michael Nestler, 102 Lakewood Cir., Vicksburg, MS (US) 39180

( * ) Notice: Subject to any disclaimer, the term of this patent is extended or adjusted under 35 U.S.C. 154(b) by 0 days.

(21) Appl. No.: 09/131,908

(22) Filed: Aug. 10, 1998

(51) Int. Cl.[7] ..... H04R 23/00
(52) U.S. Cl. ..... 367/153; 367/141; 73/170.33
(58) Field of Search ..... 367/139, 141, 367/153, 155; 181/122, 402; 73/170.33

(56) References Cited

U.S. PATENT DOCUMENTS 3,990,035 * 11/1976 Byers ..... 367/141
4,328,569 * 5/1982 Trott et al. ..... 367/153
4,648,082 * 3/1987 Savit ..... 367/149
5,392,258 * 2/1995 Gabrielson et al. ..... 181/122
5,517,465 * 5/1996 Nestler et al. ..... 367/153
5,657,296 * 8/1997 Carter ..... 367/153

* cited by examiner

*Primary Examiner*—Ian J. Lobo

(57) ABSTRACT

Apparatus for studying the variations in hydrodynamic pressure for correlation with fish movement towards and away from zones of danger comprises a hollow winged section having mounted on the surface thereof, piezoelectric sensors, and an accelerometer mounted within the apparatus, for generating electrical signals that are processed and interpreted by remote electronic means.

3 Claims, 1 Drawing Sheet

MULTIPLE PRESSURE GRADIENT SENSOR

GOVERNMENT INTEREST STATEMENT

Figure 1:
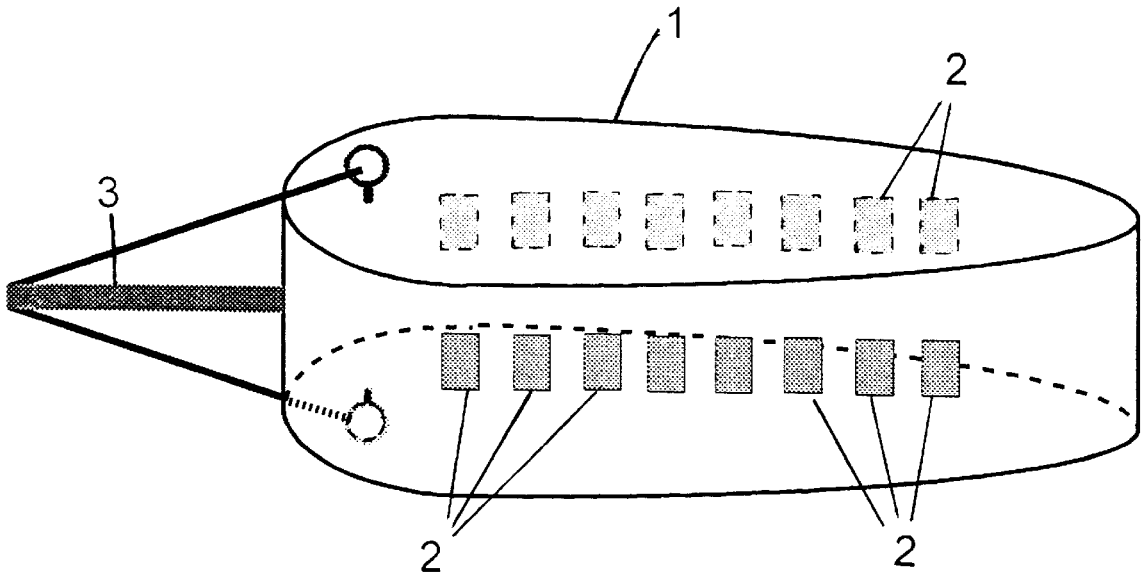

The invention described herein may be manufactured, licensed, and used by or for governmental purposes without the payment of any royalties thereon.

I. BACKGROUND OF THE INVENTION

1. Field of Invention

This invention relates to apparatus for studying the relation between hydrodynamic pressure variations in water and fish behavior. More specifically, it relates to apparatus used to study the variations in hydrostatic pressure and particle motion for correlations with fish movement towards and away from, zones of danger to fish, such as the intakes of hydroelectric power generating turbines.

2. Prior Art

Studies in the past of fish behavior were based on simulation of the hydrodynamic pressure variation in the water surrounding a fish, and to this end, plastic models in the shape of a fish were used, as disclosed in U.S. Pat. No. 5,517,465 to the inventors of the present invention.

II. SUMMARY OF THE INVENTION

Many valuable fish species are in serious decline, requiring human intervention to prevent further decline and extinction. Such intervention includes the use of apparatus and methods for diverting or repelling fish away from zones of danger to fish, such as the intakes of hydrolelectric power generating turbines, or the intakes of pumping stations used during off-peak hours for pumping water from the low side of the hydroelectric power dam to the upstream reservoir, for later release through the turbines during peak demand periods, or the intakes of water diversion structures.

The apparatus of this invention is a foil-shaped body having a winged section that ensures minimum obtrusiveness and a predictable water flow pattern around the body shape. The sensory system has piezoelectric sensors mounted on the exterior curved surfaces of the winged section, which is immersed in flowing water, and the output of the sensors is transmittted by cable to equipment for interpreting the sensor output.

III. BRIEF DESCRIPTION OF THE DRAWING

FIG. 1 shows a schematic view of the multiple sensor pressure gradient sensor of this invention.

IV. DETAILED DESCRIPTION OF THE INVENTION

With reference to FIG. 1, the pressure gradient sensor has the shape of a winged section forming a hollow enclosure 1. Fiberglass-reinforced epoxy or polyester resins are the preferred materials for constructing the hollow enclosure. Other materials may be used provided that they seal the interior of the winged section against water intrusion. The winged section has a leading and trailing edge and two curved smooth surfaces. A plurality of piezoelectric sensors 2, ranging in number from 2 to 100 but preferably about 16, are mounted on the exterior of the curved surfaces of the winged section. These sensors measure variations in water pressure. The electrical output signals of the sensors, caused by these variations in water pressure, pass by wires (not shown) to the interior of the hollow enclosure, being properly sealed against water leakage. The wiring from the sensors (not shown) further pass through a cable 3 connecting to the winged section which also serves as a mechanical support for the winged section and for locating the winged section at its desired location in the water stream. The wires transmitting the sensor outputs are connected to remote electronic means for interpreting the signal output of the piezoelectric sensors (not shown). Optionally, a portion of the electronic data processing equipment may be located in the hollow space inside the winged section (not shown).

Also mounted within the body of the pressure gradient sensor is an accelerometer which senses body movement. The output of the pressure sensors are mathematically operated on by the accelerometer to cancel out the pressure output created by body movement.

While this invention has been described in terms of a specific preferred embodiment, it is understood that it is capable of further modification and adaptation of the invention following in general the principle of the invention and including such departures from the present disclosure as come within the known or customary practice in the art to which the invention pertains and may be applied to the central features set forth, and fall within the scope of the invention and of the limits of the appended claims.

What is claimed is:

1. Apparatus for studying the relation between hydrodynamic pressure variations in water, mainly water particle motion, and fish behavior comprising:

(a) a hollow winged section having curved surfaces for minimizing obtrusiveness of water flow on said surfaces, and said section forming an enclosure;

(b) a plurality of piezoelectric sensors mounted on the exterior of the curved surfaces of the hollow winged section, for generating electrical signals in response to variations in hydrodynamic pressure of each piezoelectric sensor in the water;

(c) electrical wires connected to the sensors for transmitting electrical signals from the sensors, passing to the inside of the enclosure;

(d) a supporting cable affixed to the enclosure, the electrical wires from the sensors passing through the cable;

(e) an accelerometer, for sensing the body movement of the apparatus, having an output that mathematically operates on the electrical signals of the piezoelectric sensors to cancel out the pressure output created by body movement of the apparatus; and (f) electronic means for processing, interpreting and displaying output signals received from the sensors.

2. Apparatus according to claim 1 wherein the enclosure is made of fiberglass-reinforced epoxy resin.

3. Apparatus according to claim 1 wherein the number of sensors is between 2 and 100.

* * * * *